US007827966B2

(12) United States Patent
Narisako et al.

(10) Patent No.: US 7,827,966 B2
(45) Date of Patent: Nov. 9, 2010

(54) FUEL SUPPLY APPARATUS

(75) Inventors: Hideki Narisako, Kariya (JP); Yukihiro Shinohara, Kariya (JP); Takashi Kikutani, Ama-gun (JP); Toshiyuki Yonemoto, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 12/428,687

(22) Filed: Apr. 23, 2009

(65) Prior Publication Data

US 2009/0283074 A1 Nov. 19, 2009

(30) Foreign Application Priority Data

May 15, 2008 (JP) ..... 2008-128320

(51) Int. Cl.
*F02M 37/22* (2006.01)

(52) U.S. Cl. ..... 123/497; 123/511; 123/514

(58) Field of Classification Search ..... 123/497, 123/510, 511, 514, 435
See application file for complete search history.

(56) References Cited

U.S. PATENT DOCUMENTS

| | | | | |
|---|---|---|---|---|
| 5,626,114 | A * | 5/1997 | Kushida et al. | 123/198 D |
| 7,207,319 | B2 * | 4/2007 | Utsumi | 123/446 |
| 7,493,893 | B2 * | 2/2009 | Funabashi et al. | 123/497 |
| 2002/0092505 | A1 * | 7/2002 | Rembold et al. | 123/464 |

FOREIGN PATENT DOCUMENTS

| | | |
|---|---|---|
| EP | 0 819 844 | 1/1998 |

* cited by examiner

*Primary Examiner*—Hai H Huynh
(74) *Attorney, Agent, or Firm*—Nixon & Vanderhye PC

(57) ABSTRACT

An ECU reduces a fuel flow rate discharged from an electric pump to the filter when a fuel temperature and a fuel pressure in the filter detected by a sensor portion drop. Since a mechanical pump continues to be driven without respect to the fuel quantity discharged from the electric pumps when the fuel flow rate discharged from the electric pump is decreased, a suction pressure is generated at an inlet of the filter. The fuel in a recirculation passage is introduced into the filter through a branch passage. As the result, relatively high temperature fuel is introduced into the filter to melt a solidified fuel causing a clogging of the filter.

6 Claims, 5 Drawing Sheets

FUEL SUPPLY APPARATUS

CROSS-REFERENCE TO RELATED APPLICATION

This application is based on Japanese Patent Application No. 2008-128320 filed on May 15, 2008, the disclosure of which is incorporated herein by reference.

FIELD OF THE INVENTION

The present invention relates to a fuel supply apparatus capable of reducing a clogging of a filter due to a solidified fuel.

BACKGROUND OF THE INVENTION

Light oil, which is used for a diesel engine as fuel, includes components that are solidified when temperature drops. The solidified fuel causes a clogging of a filter. The filter captures foreign objects contained in the fuel. High temperature fuel which becomes excessive in a common rail or a fuel injector is recirculated into an inlet of the filter to melt the solidified fuel. Alternatively, the solidified fuel is heated by a heater to be melted.

However, in a case that a filter is disposed at an outlet of a fuel pump, the pressure of fuel discharged by the fuel pump is higher than that of fuel recirculated. Thus, it is difficult to introduce the recirculated fuel toward the filter. For example, EP-0819844A2 shows that the recirculated fuel is introduced into an inlet of a filter which is disposed outlet side of the fuel pump. Thus, it is necessary to increase the pressure of the recirculated fuel in order to introduce the recirculated fuel into the filter, which causes an increase in pressure resistance of pipes and parts through which the recirculated fuel flows. Besides, in a case that the filter is heated by a heater, a heat source, an electric power source, and electric leads are needed, which increase a number of parts.

SUMMARY OF THE INVENTION

The present invention is made in view of the above matters, and it is an object of the present invention to provide a fuel supply apparatus capable of reducing a clogging of a filter due to a solidified fuel without increasing a number of parts, complicating a structure, and increasing a recirculated fuel pressure.

According to the present invention, a filter is provided between an electric pump suctioning a fuel from a fuel tank and a mechanical pump pressurizing the fuel suctioned by the electric pump. A branch passage branched from a recirculation passage is fluidly connected to an inlet of the filter. An excessive fuel flows in the recirculation passage. A control unit controls an operation of the electric motor to reduce the fuel quantity discharged from the electric pump to the filter when a pressure loss of the fuel in the filter is increased. The mechanical pump continues to be driven without respect to the fuel quantity discharged from the electric pump. If the fuel quantity discharged from the electric pump is decreased, a suction pressure is generated at an inlet portion of the mechanical pump. Thereby, the fuel recirculated from the branch passage to the fuel tank is introduced into the filter. As the result, a relatively high temperature fuel which should be recirculated into the fuel tank is introduced into the filter so that the solidified fuel causing a clogging of the filter is melted. That is, by reducing the fuel quantity discharged from the electric pump, the mechanical pump introduces the high temperature fuel into the filter without increasing the recirculated fuel pressure and heating the filter. Thus, a clogging of the filter due to the solidified fuel can be reduced without increasing the number of parts, complicating the structure, and increasing the pressure of the recirculated fuel.

According to another aspect of the present invention, the control unit controls the fuel quantity discharged from the electric pump based on the fuel temperature and the fuel pressure. When the fuel temperature is lower than a lower limit temperature and the fuel pressure is lower than the lower limit pressure, the fuel quantity discharged from the electric pump is reduced. When the fuel temperature is low, there is a possibility that a component contained in the fuel of which melting point is low is solidified. Further, when the fuel pressure passing through the filter is low, there is a possibility that the filter is clogged. When the fuel temperature and the fuel pressure are low, the control unit determines that the filter is clogged due to the solidified fuel and reduces the fuel quantity discharged from the electric pump. Thereby, the fuel recirculated from the branch passage is introduced into the filter by a suction pressure of the mechanical pump. Thus, a clogging of the filter due to the solidified fuel can be reduced with a simple configuration.

According to another aspect of the present invention, the control unit outputs a stop command to stop the electric pump, or a flow rate reducing command to reduce the fuel quantity discharged from the electric pump. The fuel quantity discharged from the electric pump is varied based on a clogging degree of the filter. Thus a clogging of the filter due to a solidified fuel can be reduced.

According to another aspect of the present invention, the branch passage is provided with a check valve or a restriction. Usually, the fuel suctioned by the electric pump is introduced from the fuel tank to the filter. When the filter is clogged and the fuel pressure at the inlet of the mechanical pump is decreased, the recirculated fuel flows into the filter through the check valve or the restrictor. Thus, a clogging of the filter due to a solidified fuel can be reduced.

According to another aspect of the present invention, the fuel supply apparatus is further provided with a bypass passage. The mechanical pump can suction the fuel from the fuel tank through the bypass passage bypassing the electric pump. When the fuel flow rates suctioned from the branch passage is insufficient, the fuel is supplied through the bypass passage. Further, the bypass passage is provided with a check valve. If the fuel quantity discharged from the mechanical pump is insufficient, the fuel is suctioned from the fuel tank through the bypass passage. Thus, the fuel quantity supplied from the mechanical pump can be maintained.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Figure 1:
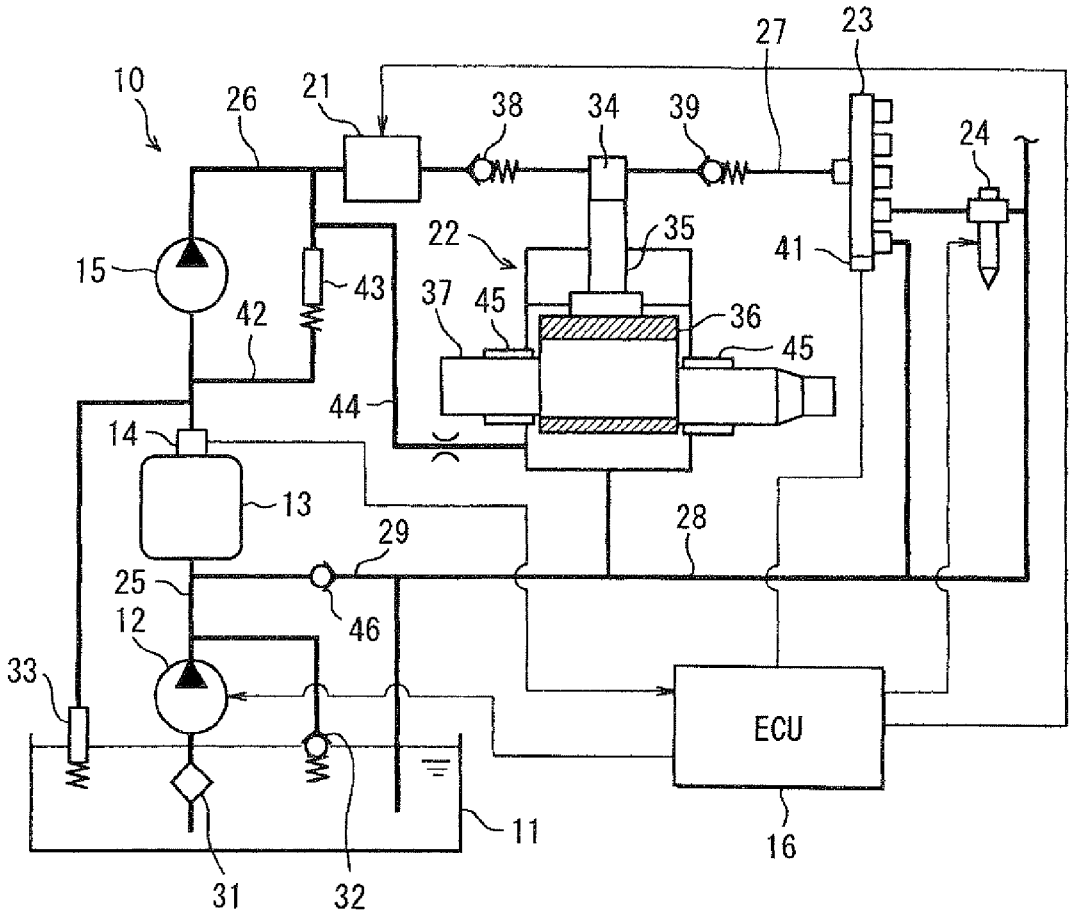
FIG. 1 is a schematic view showing a configuration of a fuel supply apparatus according to a first embodiment of the present invention.

Hereafter, a plurality of embodiments of the present invention are described. In each embodiment, the substantially same parts and the components are indicated with the same reference numeral and the same description will not be reiterated.

First Embodiment

FIG. 1 is a schematic view showing a fuel supply apparatus according to a first embodiment. A fuel supply apparatus 10 is applied to a common-rail type fuel injection system supplying fuel to a diesel engine (not shown). The fuel supply apparatus 10 is provided with a fuel tank 11, an electric pump 12, a filter 13, a sensor portion 14, a mechanical pump 15, and an electronic control unit (ECU) 16. The fuel injection system is further provided with a flow controller 21, a supply pump 22, a common rail 23, and a fuel injector 24. Further, the fuel supply apparatus 10 is provided with a suction passage 25 fluidly connecting the fuel tank 11 and the filter 13, a supply passage 26 fluidly connecting the filter 13 and the supply pump 22, a high-pressure passage 27 fluidly connecting the supply pump 22 and the common rail 23, a recirculation passage 28 fluidly connecting the supply pump 22, the common rail 23, the fuel injector 24 and the fuel tank 11, and a branch passage 29 branched from the recirculation passage 28 and fluidly connected to the suction passage 25.

The fuel tank 11 stores the fuel of room temperature. A suction filter 31 is provided to one end of the suction passage 25 in the fuel tank 11. The suction filter 31 captures relatively large foreign matters contained in the fuel. The electric pump 12 is provided in the suction passage 25 to pump up the fuel in the fuel tank 11 receiving electric power from the ECU 16. The electric pump 12 supplies the fuel to the filter 13 through the suction passage 25. A pressure regulator 32 is provided between an outlet of the electric pump 12 and the filter 13. The pressure regulator 32 regulates pressure of the fuel discharged from the electric pump 12.

The filter 13 includes a filter case and a filter element (not shown). The filter element is made from filter paper or nonwoven, and is accommodated in the filter case. The filter 13 captures relatively small foreign matters in the fuel, which are not removed by the suction filter 31. The sensor portion 14 is provided to an outlet of the filter 13. The sensor portion 14 includes a temperature sensor and a pressure sensor. The temperature sensor detects fuel temperature flowing through the filter 13, and sends a temperature signal to the ECU 16. The pressure sensor detects fuel pressure flowing through the filter 13, and sends a pressure signal to the ECU 16. A pressure controller 33 is connected between the filter 13 and the mechanical pump 15. When a fuel pressure between the filter 13 and the mechanical pump 15 becomes excessively large, the pressure controller 33 returns a part of fuel in the suction passage 25 to the fuel tank 11. The pressure controller 33 keeps the fuel pressure constant at outlet side of the filter 13.

The fuel passed through the filter 13 is pressurized by the mechanical pump 15. The mechanical pump 15 is driven by the diesel engine (not shown). The mechanical pump 15 is disposed in the supply passage 26, and supplies the pressurized fuel to the supply pump 22. The flow controller 21 is disposed between the mechanical pump 15 and the supply pump 22. The flow controller 21 controls fuel flow rate discharged from the mechanical pump 15 based on a command signal from the ECU 16. The fuel of which flow rate is controlled by the flow controller 21 is supplied to the supply pump 22.

The supply pump 22 has a plunger 35 reciprocating in a pressurizing chamber 34. The plunger 35 is in contact with a cam ring 36 at its end opposite to the pressurizing chamber 34. The cam ring 36 is eccentric to a shaft 37. The cam ring 36 eccentrically rotates along with the shaft 37 when a crankshaft of the diesel engine rotates. Thereby, the plunger 35 reciprocates in the pressurizing chamber 34. The fuel in the pressurizing chamber 34 is pressurized to a specified pressure. The supply pump 22 is provided with a first and a second check valve 38, 39. The first check valve 38 prevents a pressurized fuel from back-flowing into the flow controller 21. The second check valve 39 allows a fuel flow from the pressurizing chamber 34 toward the common rail 23 when the fuel pressure in the pressurizing chamber 34 attains to a specified pressure.

The common rail 23 accumulates high-pressure fuel pressurized by the supply pump 22. The common rail 23 is provided with a pressure sensor 41. The ECU 16 controls the flow controller 21 based on the pressure in the common rail 23 detected by the pressure sensor 41, whereby the fuel flow rate supplied from the supply pump 22 to the common rail 23 is controlled. A fuel injector 24 is fluidly connected to the common rail 23. The fuel injector 24 is provided to each cylinder of the diesel engine. The fuel injector 24 injects fuel accumulated in the common rail 23 into each cylinder at a predetermined timing. The fuel injector 24 is provided with an electromagnetic driver (not shown). The ECU 16 sends a command signal to the electromagnetic driver to perform a fuel injection by the fuel injector 24.

Most of the fuel discharged from the mechanical pump 15 is supplied to the pressurizing chamber 34 of the supply pump 22 through the flow controller 21. A part of the fuel discharged from the mechanical pump 15 is returned to an inlet of the mechanical pump 15 through a feedback passage 42. A pressure adjuster 43 adjusting fuel pressure is disposed in the feedback passage 42. An excessive fuel out of the fuel discharged from the mechanical pump 15 is returned to a low-pressure portion of the supply pump 22 through a pressure adjust passage 44. The fuel returned to the low-pressure portion of the supply pump 22 lubricates the shaft 37, the cam ring 36, and bearings 45, and then flows into the recirculation passage 28 with the excessive fuel. An excessive fuel in the common rail 23 and the fuel injector 24 also flow into the recirculation passage 28. The recirculation passage 28 introduces the excessive fuel in the supply pump 22, the common rail 23 and the fuel injector 24 into the fuel tank 11. A temperature of the fuel returned to the fuel tank 11 through the recirculation passage 28 is increased due to the pressurization by the supply pump 22 and the accumulation by the common rail 23. Since the fuel injector 24 is provided to each cylinder of the diesel engine, the temperature of the fuel passed through the fuel injector 24 is also increased. As the result, the temperature of the fuel returned to the fuel tank 11 through the recirculation passage 28 is higher than that of the fuel stored in the fuel tank 11.

The branch passage 29 is branched from the recirculation passage 28. The branch passage 29 is connected to the suction passage 25 between the electric pump 12 and the filter 13. The branch passage 29 is provided with a third check valve 46. The third check valve 46 allows a fluid flow from the recirculation passage 28 to the suction passage 25, and restricts a fuel flow from the suction passage 25 to the recirculation passage 28.

The ECU 16 is mainly constructed of a microcomputer having a CPU, a ROM and a RAM. The ECU 16 is electrically connected to the electric pump 12, the sensor portion 14, the flow controller 21, the common rail 23, and the fuel injector 24. The ECU 16 computes a fuel injection quantity based on a stepped amount of an accelerator pedal detected by an accelerator position sensor (not shown). The ECU 16 controls the eclectic pump 12 and the flow controller 21 based on the computed fuel injection quantity and the fuel pressure in the common rail 23 detected by the pressure sensor 41. Thereby, the fuel pressure in the common rail 23 can be kept at a specified pressure. The ECU 16 sends a command signal to the electromagnetic driver of the fuel injector 24 at a specified timing to perform a fuel injection by the fuel injector 24. Based on the temperature and pressure of the fuel passed through the filter 13 detected by the sensor portion 14, the ECU determines whether a clogging of the filter 13 exists due to a solidified fuel. Furthermore, the ECU 16 outputs a stop command or a flow rate reducing command to the electric pump 12. When the ECU 16 outputs the stop command to the electric pump 12, an operation of the electric pump 12 is terminated. When the ECU 16 outputs the flow rate reducing command to the electric pump 12, a fuel quantity discharged from the electric pump 12 is reduced.

Figure 2:
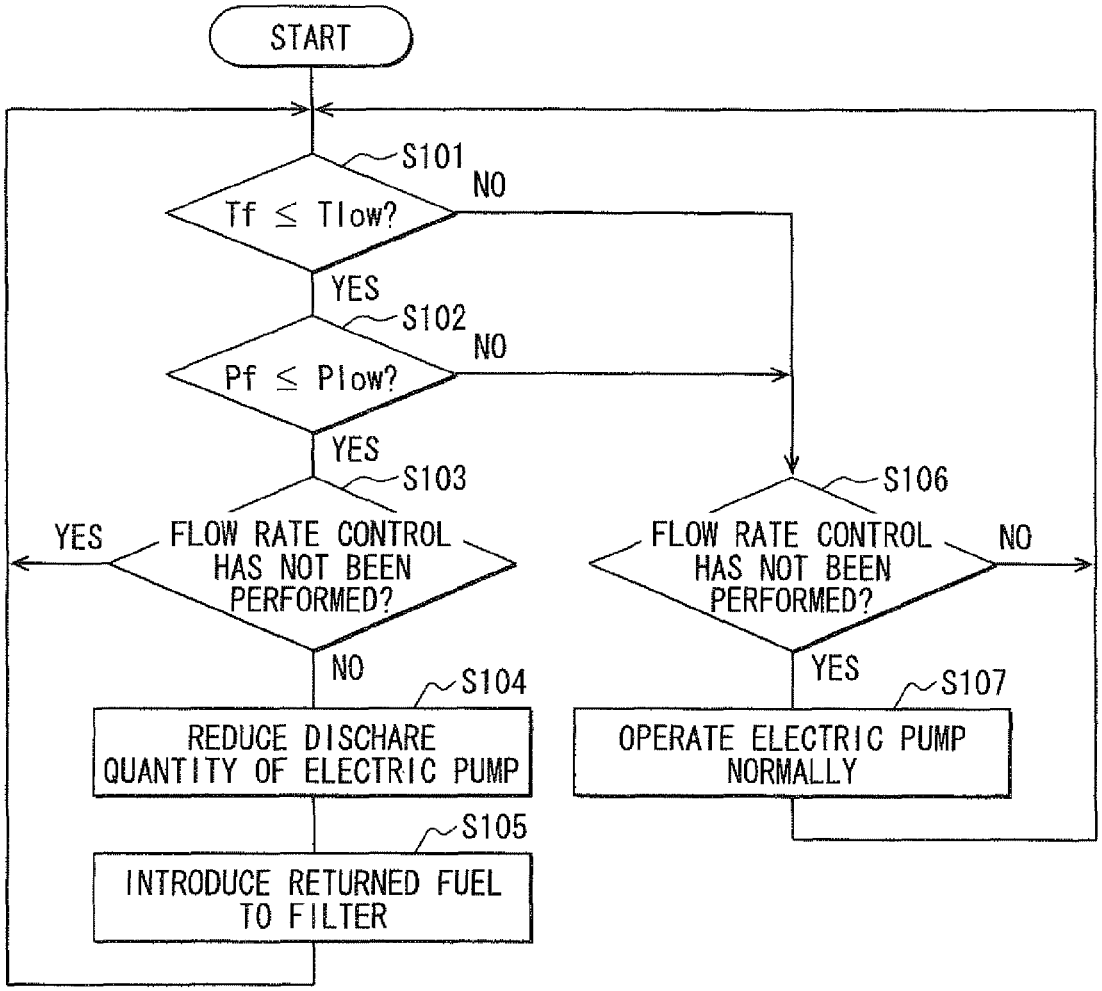
FIG. 2 is a flowchart showing an operation of the fuel supply apparatus according to the first embodiment.

An operation of the fuel supply apparatus 10 will be described hereinafter. As described above, based on the temperature and pressure of the fuel passed through the filter 13 detected by the sensor portion 14, the ECU determines whether a clogging of the filter 13 exists due to a solidified fuel. When the ECU 16 determines that a clogging of the filter 13 is caused due to the solidified fuel, the fuel flow rate discharged from the electric pump 12 is reduced and the fuel flowing through the recirculation passage 28 is introduced into the filter 13. Referring to FIG. 2, a process for introducing the fuel in the recirculation passage 28 into the filter 13 will be described hereinafter.

In S101, the ECU 16 determines whether a fuel temperature Tf is lower than or equal to a lower limit temperature Tlow. That is, the ECU 16 detects a temperature of fuel flowing through the filter 13 by means of a temperature sensor of the sensor potion 14. Then, the ECU 16 determines whether the detected fuel temperature Tf is lower than or equal to the lower limit temperature Tlow. The lower limit temperature Tlow is temperature at which a component contained in the fuel is solidified. That is, the lower limit temperature Tlow is a freezing point of the fuel or a temperature around the freezing point of the fuel. When the fuel temperature Tf is lower than the lower limit temperature Tlow, a component contained in the fuel is solidified, so that the solidified fuel is accumulated on the filter 13. The fuel temperature Tf may be estimated based on ambient temperature of a vehicle, coolant temperature of the diesel engine, or suction air temperature of the diesel engine.

When the answer is Yes in S101, the procedure proceeds to S102 in which the ECU 16 determines whether a fuel pressure Pf is lower than or equal to a lower limit pressure Plow. That is, the ECU 16 detects a pressure of fuel flowing through the filter 13 by means of the pressure sensor of the sensor potion 14. In the present embodiment, the ECU 16 detects a fuel pressure downstream of the filter 13. Then, the ECU 16 determines whether the detected fuel pressure Pf is lower than or equal to the lower limit pressure Plow. If the filter 13 is clogged, the fuel flow rate passing through the filter 13 is decreased and the fuel pressure passed through the filter 13 is decreased. Thus, when the fuel pressure passed through the filter 13 is not more than the lower limit pressure Plow, the ECU 16 determines that the filter 13 is clogged.

When the answer is Yes in S102, the procedure proceeds to S103 in which the ECU 16 determines whether a flow rate control to the fuel flowing into the filter 13 has not been performed. When the ECU 16 determines that the flow rate control has not been performed in S103, the procedure proceeds to S104 in which the fuel quantity discharged from the electrical pump 12 is reduced. That is, the ECU 16 outputs the flow rate reducing command to the electric pump 12 so that the fuel quantity discharged from the electric pump 12 is reduced. Alternatively, the ECU 16 may output the stop command to stop the fuel supply from the electric pump 12 to the filter 13.

When the electric pump 12 is stopped, the fuel which should be returned to the fuel tank 11 is introduced into the filter in S105. Specifically, when the electric pump 12 is stopped, the fuel flow rate flowing from the electric pump 12 to the filter 13 decreases. Meanwhile, the mechanical pump 15 continues to be driven along with the diesel engine operation without respect to the fuel quantity discharged from the electric pump 12. Thereby, since the fuel quantity discharged from the electric pump 12 decreases while the fuel quantity which the mechanical pump 15 suctions from the filter 13 is unchanged, the fuel pressure in the filter 13 and at an inlet of the filter 13 is decreased. When the fuel pressure at the inlet of the filter 13 becomes lower than that in the branch passage 29, the third check valve 46 opens. Thus, the fuel flowing in the recirculation passage 28 flows into the suction passage 25 through the branch passage 29. That is, the fuel in the recirculation passage 28 flows into the filter 13. As described above, the temperature of the fuel returned to the fuel tank 11 through the recirculation passage 28 is higher than that of the fuel stored in the fuel tank 11. The fuel of high temperature is introduced into the suction passage 25 from the recirculation passage 28, whereby the fuel of which temperature is higher than the freezing point of the fuel is introduced into the filter 13. As the result, the solidified fuel causing a clogging of filter 13 is melted by the high temperature fuel.

When the answer is No in S101 or S102, the procedure proceeds to S106 in which the ECU 16 determines whether the flow rate control to the fuel flowing into the filter 13 has not been performed. When the ECU 16 determines that the flow rate control has been performed in S106, the procedure proceeds to S107 in which an operation of the electric pump 12 is returned to a normal operation. That is, the ECU 16 drives the electric pump 12 in a normal condition so that the fuel flow rate supplied from the electric pump to the filter 13 is recovered.

When the answer is Yes in S103 or when the answer is No in S106, the procedure goes back to S101. The ECU 16 repeats the above process until the diesel engine is stopped.

As described above, according to the first embodiment, the ECU 16 reduces the fuel flow rate discharged from the electric pump 12 to the filter 13 when the fuel temperature and the fuel pressure in the filter 13 drop. The mechanical pump 15 continues to be driven along with the diesel engine operation without respect to the fuel quantity discharged from the electric pump 12. Thus, when the fuel flow rate discharged from the electric pump 12 is decreased, a suction pressure is generated at the inlet of the filter 13. The fuel in the recirculation passage 28 is introduced into the filter through the branch passage 29. As the result, relatively high temperature fuel is introduced into the filter 13 to melt the solidified fuel causing a clogging of the filter 13. That is, by reducing the fuel quantity discharged from the electric pump 12, the mechanical pump 15 suctions the relatively high temperature fuel, so that the high temperature fuel is introduced into the filter 13 without increasing the recirculated fuel pressure and heating the filter 13. Thus, a clogging of the filter 13 due to the solidified fuel can be reduced without increasing the number of parts, complicating the structure, and increasing the pressure of the recirculated fuel.

According to the first embodiment, the branch passage 29 is provided with the third check valve 46. Thus, the fuel which the electric pump 12 suctions from the fuel tank 11 ordinarily flows into the filter 13. If the filter 13 is clogged and the pressure at the inlet of the filter 13 decreases, the third check valve 46 is opened to introduce the fuel in the recirculation passage 28 to the filter 13. Therefore, a clogging of the filter 13 due to a solidified fuel can be reduced.

Second Embodiment

Figure 3:
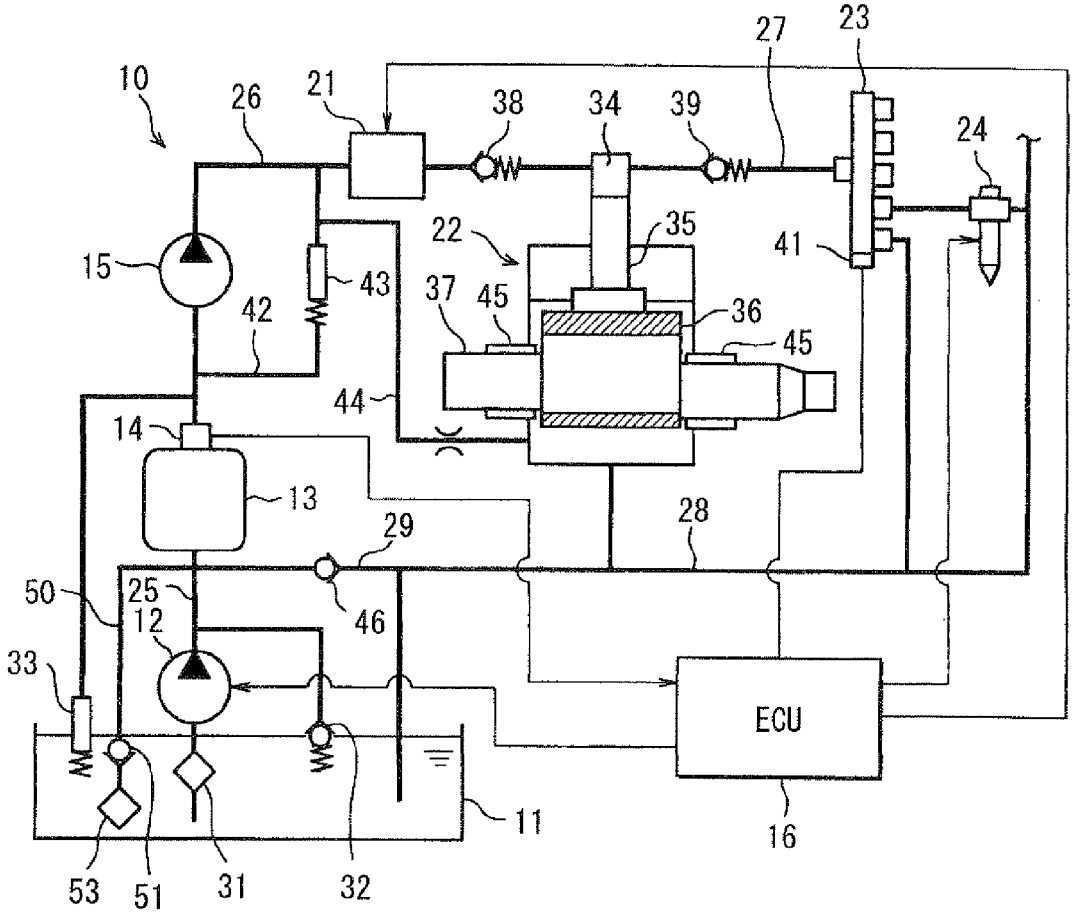
FIG. 3 is a schematic view showing a configuration of a fuel supply apparatus according to a second embodiment of the present invention.

FIG. 3 is a schematic view showing a fuel supply apparatus according to a second embodiment. As shown in FIG. 3, the fuel supply apparatus 10 is provided with a bypass passage 50 and a fourth check valve 51. The bypass passage 50 fluidly connects the fuel tank 11 and the inlet side of the filter 13 in the suction passage 25. The bypass passage 50 is provided with a suction filter 53 at its end in the fuel tank 11. The fourth check valve 51 is provided in the bypass passage 50. The fourth check valve 51 allows a fuel flow from the fuel tank 11 to the filter 13, and restricts a fuel flow from the filter 13 to the fuel tank 11. The check valve 51 may be disposed outside of the fuel tank 11.

As described above, when the fuel temperature and the fuel pressure passing through the filter 13 drop, the rotational speed of the electric pump 12 is decreased or the electric pump 12 is stopped. The fuel in the branch passage 29 is introduced into the filter 13 by a suction operation of the mechanical pump 15. However, there is a possibility that the fuel quantity introduced into the filter 13 is insufficient, which depends on a fuel quantity discharged from the mechanical pump 15 or the fuel quantity flowing in the recirculation passage 28. In this case, even if the fuel in the branch passage 29 is introduced into the filter 13, the fuel pressure at the inlet of the filter 13 is decreased. When the fuel pressure at the inlet of the filter 13 does not increase enough even though the fuel is introduced from the branch passage 29, the fourth check valve 51 opens to suction the fuel in the fuel tank 11 through the bypass passage 50. Thereby, the fuel in the fuel tank 11 can be supplied to the filter 13 through the bypass passage 50 bypassing the electric pump 12. As the result, the fuel is sufficiently supplied to the filter 13 through the bypass passage 50.

If the fuel quantity discharged from the mechanical pump 15 is insufficient, the fuel is suctioned from the fuel tank 11 through the bypass passage 50. Thus, the fuel quantity supplied from the mechanical pump 15 to the supply pump 22 can be maintained.

Other Embodiments

Figure 4:
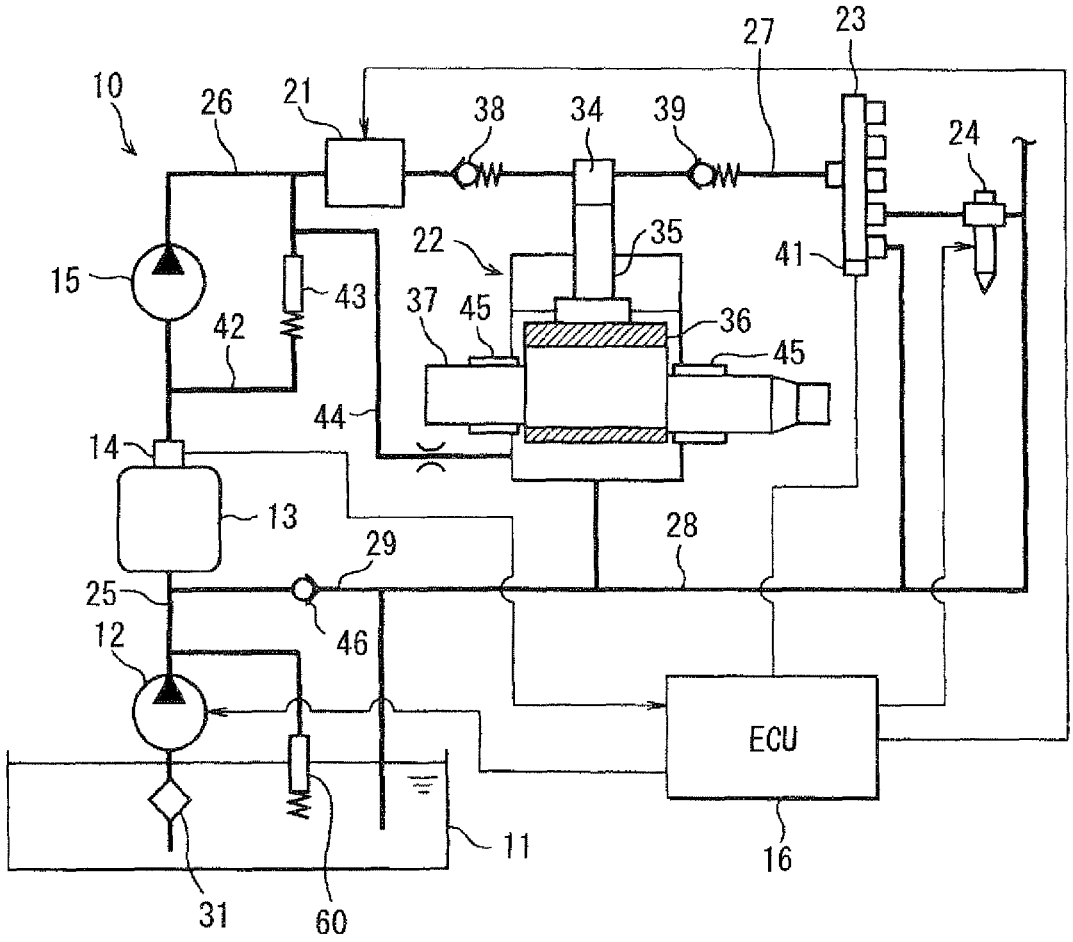
FIG. 4 is a schematic view showing a configuration of a fuel supply apparatus according to a modification of the first embodiment.
Figure 5:
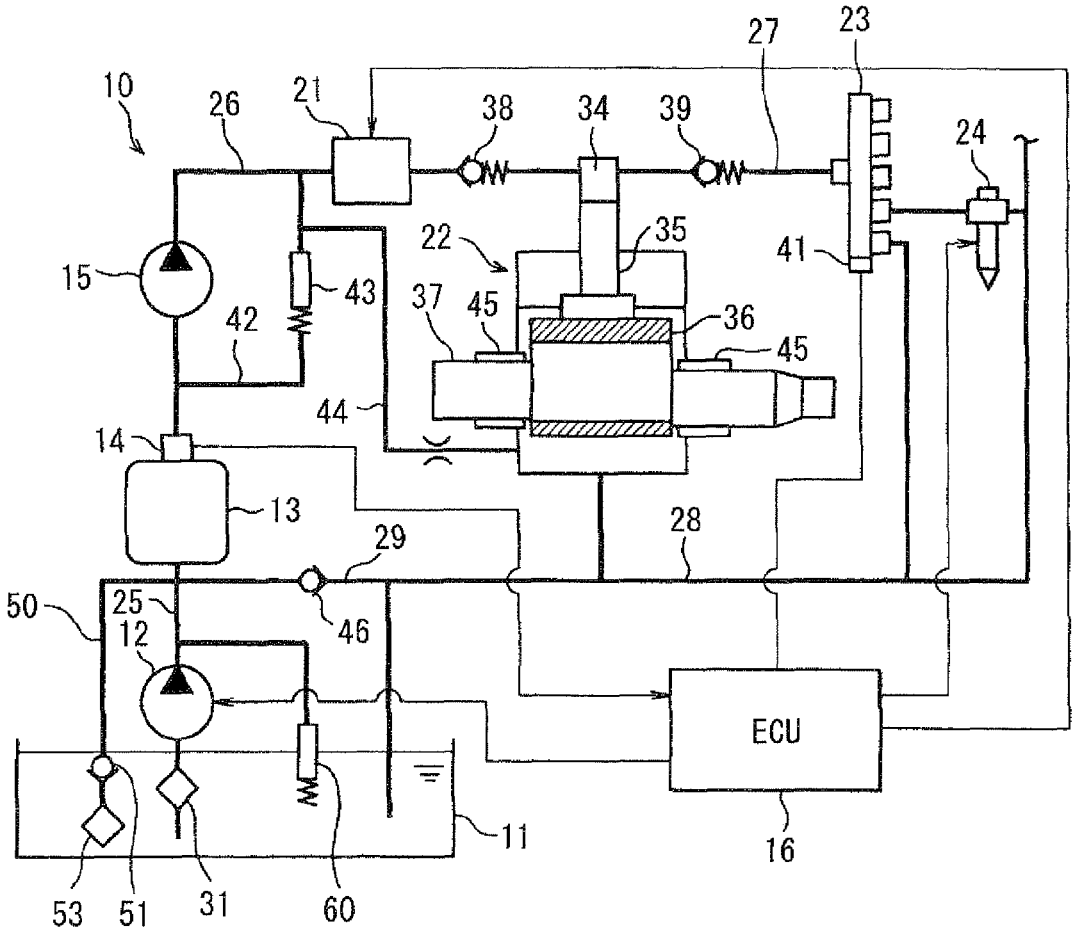
FIG. 5 is a schematic view showing a configuration of a fuel supply apparatus according to a modification of the second embodiment.

In the first and the second embodiment, the pressure controller 33 is connected to the outlet of the filter 13. FIG. 4 shows a modification of the first embodiment. As shown in FIG. 4, a pressure controller 60 can be connected to the outlet of the electric pump 12. In this modification, the pressure controller 60 has a function of the pressure regulator 32 of the first embodiment. FIG. 5 shows a modification of the second embodiment. The pressure controller 60 is connected to the outlet of the electric pump 12. Since the pressure controller 60 has a function of the pressure regulator 32, the structure can be simplified and the number of parts can be reduced. Besides, in the above embodiments, the fourth check valve 46 is disposed in the branch passage 29. Alternatively, the third check valve 46 can be replaced by a restriction.

The present invention is not limited to the embodiment mentioned above, and can be applied to various embodiments.

What is claimed is:

1. A fuel supply apparatus comprising:

an electric pump suctioning a fuel stored in a fuel tank;

a filter disposed downstream of the electric pump, the filter capturing a foreign matter contained in the fuel;

a mechanical pump disposed downstream of the filter, the mechanical pump pumping and pressurizing the fuel passed through the filter;

a recirculation passage for recirculating an excessive fuel downstream of the mechanical pump into the fuel tank;

a branch passage branched from the recirculation passage, the branch passage fluidly connecting the recirculation passage and an upstream passage fluidly connecting the electric pump and the filter; and a control unit controlling an electric power supplied to the electric pump in such a manner as to reduce a fuel flow rate discharged from the electric pump to the filter when a fuel pressure loss in the filter is increased, whereby the fuel recirculating in the recirculating passage is introduced, via the branch passage, into the upstream passage for supply to the filter.

2. A fuel supply apparatus according to claim 1, further comprising:

a temperature detecting means for detecting a fuel temperature passing through the filter; and a pressure detecting means for detecting a fuel pressure passing through the filter; wherein the control unit reduces the fuel flow rate discharged from the electric pump to the filter when the fuel temperature detected by the temperature detecting means is lower than a lower limit temperature and the fuel pressure detected by the pressure detecting means is lower than a lower limit pressure.

3. A fuel supply apparatus according to claim 1, wherein the control unit outputs a stop command to stop the electric pump or a flow rate reducing command to reduce a fuel flow rate supplied from the electric pump to the filter.

4. A fuel supply apparatus according to claim 1 wherein the branch passage is provided with a check valve allowing a fuel flow from the recirculation passage to the filter when a fuel pressure upstream of the filter is decreased.

5. A fuel supply apparatus according to claim 1, wherein the branch passage is provided with a flow restriction allowing a fuel flow from the recirculation passage to the filter when a fuel pressure upstream of the filter is decreased.

6. A fuel supply apparatus according to claim 1, further comprising:

a bypass passage for supplying a fuel from the fuel tank to the filter bypassing the electric pump when the fuel quantity flowing from the branch passage into the filter is insufficiently, wherein the bypass passage is provided with a check valve allowing a fuel flow from the fuel tank to the filter when a fuel pressure upstream of the filter is decreased.

* * * * *